US007459038B1

(12) United States Patent
Watson

(10) Patent No.: US 7,459,038 B1
(45) Date of Patent: Dec. 2, 2008

(54) METHOD FOR MAKING STEEL WITH CARBIDES ALREADY IN THE STEEL USING MATERIAL REMOVAL AND DEFORMATION

(76) Inventor: Daniel Watson, 350 Jennifer Lane, Driftwood, TX (US) 78619

( * ) Notice: Subject to any disclaimer, the term of this patent is extended or adjusted under 35 U.S.C. 154(b) by 437 days.

(21) Appl. No.: 11/141,455

(22) Filed: May 31, 2005

Related U.S. Application Data

(60) Provisional application No. 60/582,361, filed on Jun. 23, 2004.

(51) Int. Cl.
*C21D 8/00* (2006.01)

(52) U.S. Cl. ..... 148/651; 148/653; 148/652; 148/654

(58) Field of Classification Search ..... 148/326, 148/328, 547–548, 607–618, 579, 648–654, 148/660, 661, 624
See application file for complete search history.

(56) References Cited

U.S. PATENT DOCUMENTS

| | | | | |
|---|---|---|---|---|
| 4,448,613 | A | 5/1984 | Sherby et al. | |
| 4,769,214 | A | 9/1988 | Sherby et al. | |
| 5,181,970 | A * | 1/1993 | Ueda et al. | 148/610 |
| 5,445,685 | A | 8/1995 | Strum et al. | |
| 6,395,108 | B2 * | 5/2002 | Eberle et al. | 148/330 |

FOREIGN PATENT DOCUMENTS

| | | | |
|---|---|---|---|
| JP | 56-133445 | * | 10/1981 |
| JP | 09-137247 | * | 5/1997 |
| JP | 2000-273537 | * | 10/2000 |

OTHER PUBLICATIONS

Computer-generated English translation of Japanese patent 2000-273537, Oct. 2000, Suzuki, Masahito et al.*
Computer-generated English translation of Japanese patent 09-137247, Anami, Goro et al, May 27, 1997.*
Verhoeven, John D., A Review of Microsegregation Induced Banding Phenomena in Steels, Journal of Materials Engineering and Performance, vol. 9(3) Jun. 2000, pp. 286-296.
Sword Forum International, found at http://forums.swordforum.com/showthread.php?t=11162, as of Dec. 20, 2007.

* cited by examiner

*Primary Examiner*—Deborah Yee
(74) *Attorney, Agent, or Firm*—Buskop Law Group, PC; Wendy Buskop

(57) ABSTRACT

The invention is method of making steel with carbide banding obtaining steel with undissolved carbides distributed within the steel for forming steel with carbide banding, wherein the steel is about 0.3 weight percent to about 2.2 weight percent carbon and at least 0.003 weight percent of chromium, molybdenum, aluminum, vanadium, tungsten, or a similar carbide forming element; then, deforming the steel with undissolved carbide, moving a portion of the steel with undissolved carbides, heating the steel with undissolved carbides for a time ranging from about 5 minutes to about 12 hours at a temperature above an A-sub 1 temperature and below 50 degrees Fahrenheit of an A-sub 3 temperature to form an austenitic steel with undissolved carbides, and cooling the austenitic steel with undissolved carbides to maintain the undissolved carbides within a crystalline matrix forming steel with carbide banding.

44 Claims, 6 Drawing Sheets

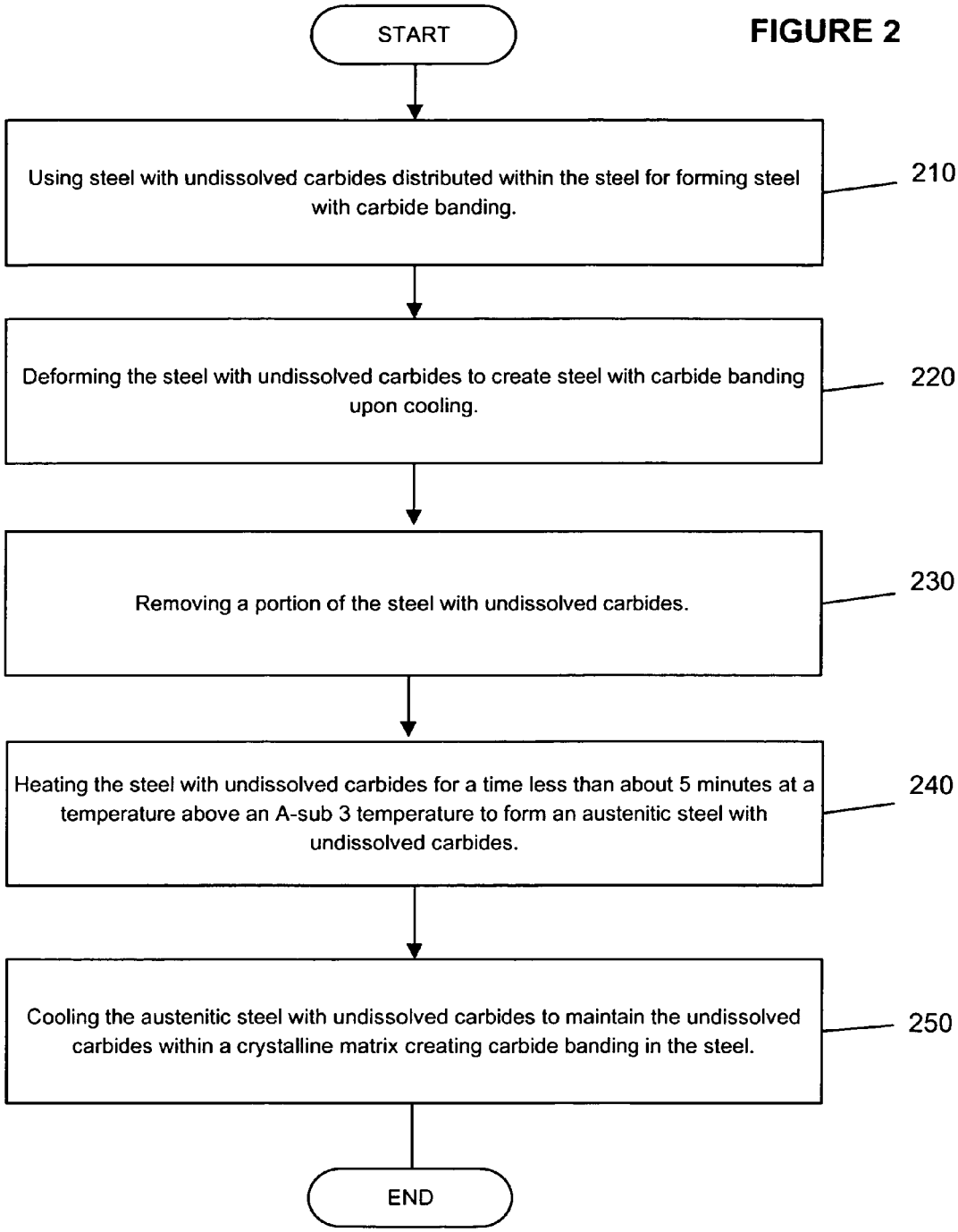
START
FIGURE 2
Using steel with undissolved carbides distributed within the steel for forming steel with carbide banding.
210
Deforming the steel with undissolved carbides to create steel with carbide banding upon cooling.
220
Removing a portion of the steel with undissolved carbides.
230
Heating the steel with undissolved carbides for a time less than about 5 minutes at a temperature above an A-sub 3 temperature to form an austenitic steel with undissolved carbides.
240
Cooling the austenitic steel with undissolved carbides to maintain the undissolved carbides within a crystalline matrix creating carbide banding in the steel.
250
END

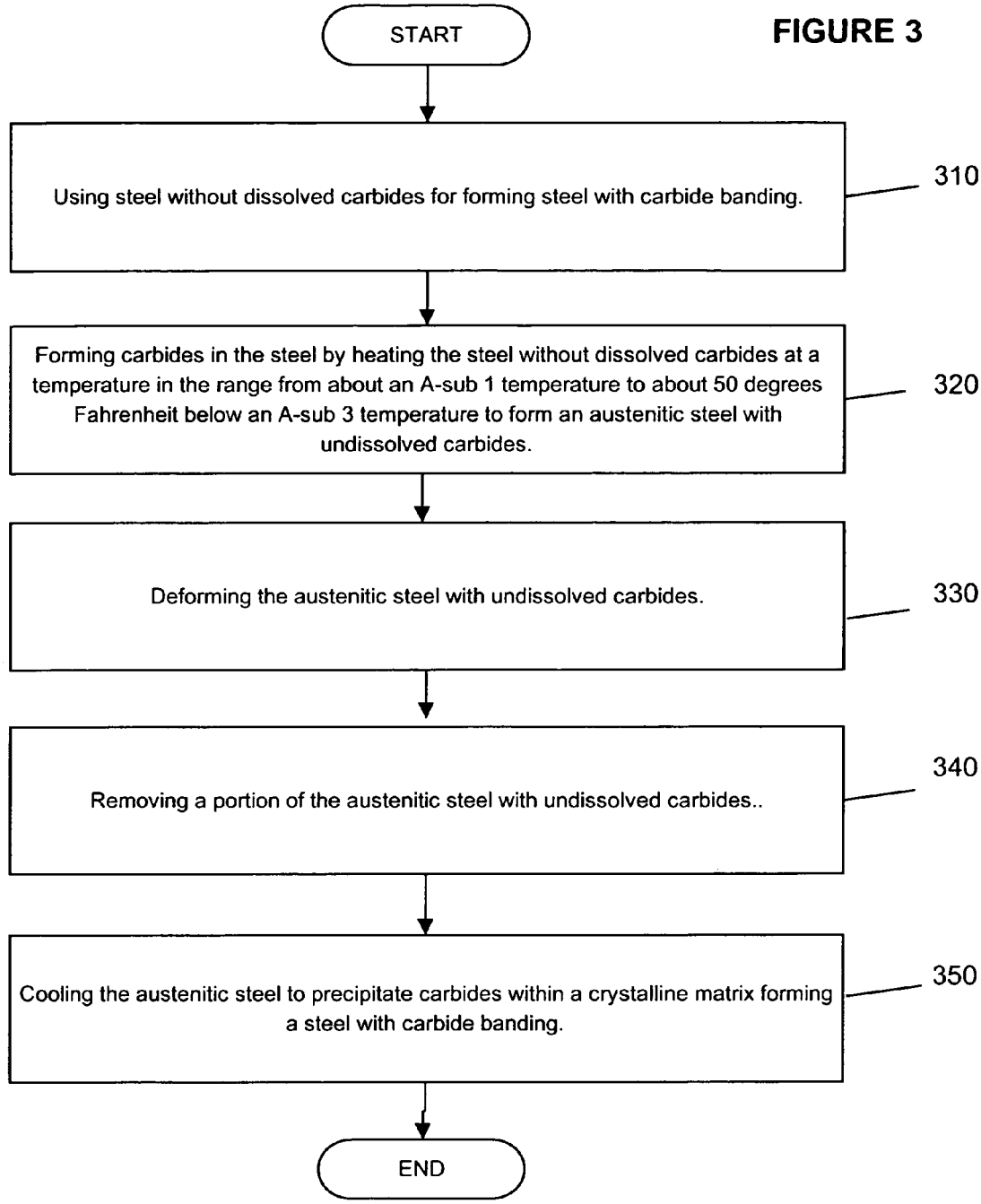
START
FIGURE 3
Using steel without dissolved carbides for forming steel with carbide banding.
310
Forming carbides in the steel by heating the steel without dissolved carbides at a temperature in the range from about an A-sub 1 temperature to about 50 degrees Fahrenheit below an A-sub 3 temperature to form an austenitic steel with undissolved carbides.
320
Deforming the austenitic steel with undissolved carbides.
330
Removing a portion of the austenitic steel with undissolved carbides..
340
Cooling the austenitic steel to precipitate carbides within a crystalline matrix forming a steel with carbide banding.
350
END

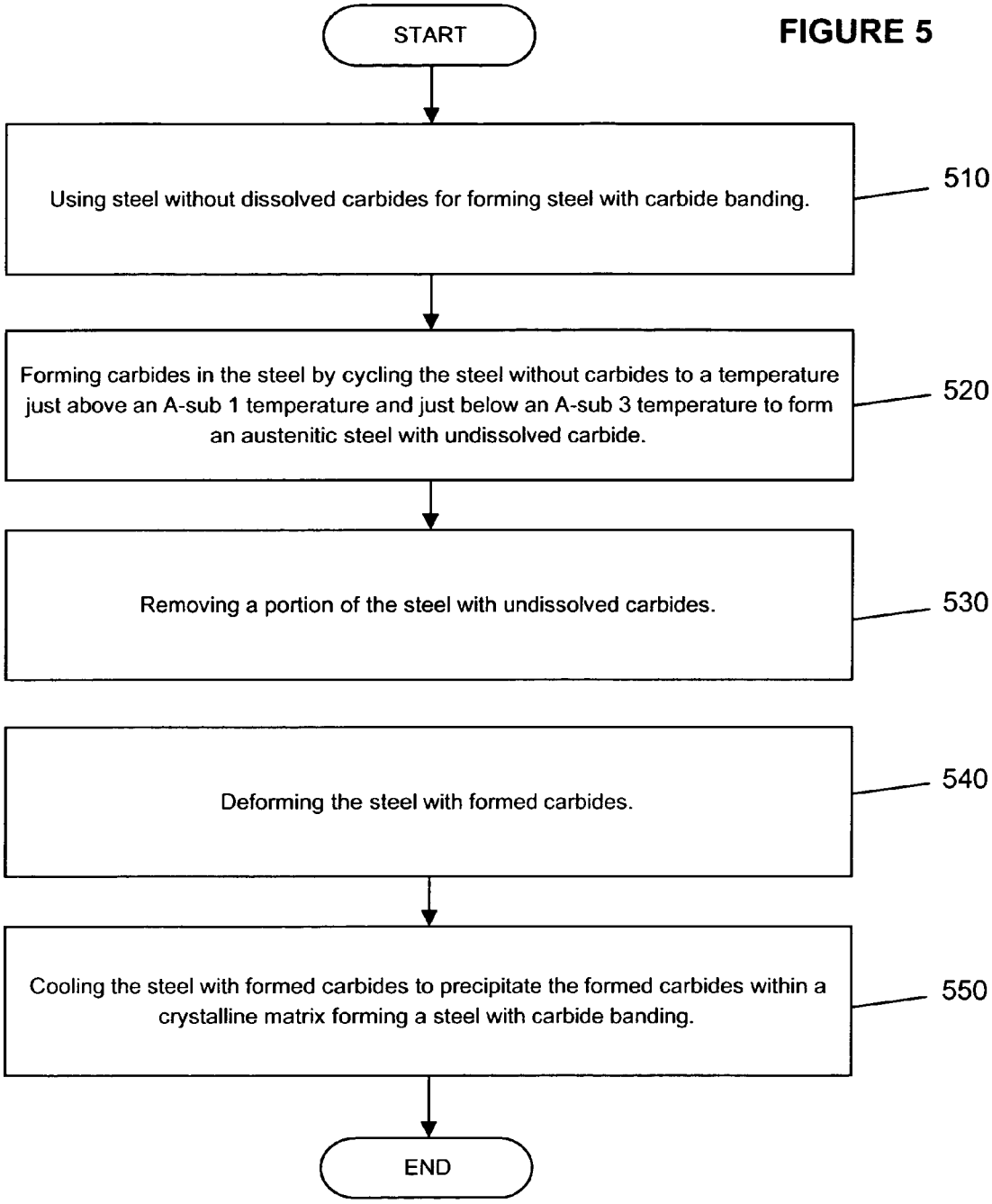
START
FIGURE 5
Using steel without dissolved carbides for forming steel with carbide banding.
510
Forming carbides in the steel by cycling the steel without carbides to a temperature just above an A-sub 1 temperature and just below an A-sub 3 temperature to form an austenitic steel with undissolved carbide.
520
Removing a portion of the steel with undissolved carbides.
530
Deforming the steel with formed carbides.
540
Cooling the steel with formed carbides to precipitate the formed carbides within a crystalline matrix forming a steel with carbide banding.
550
END

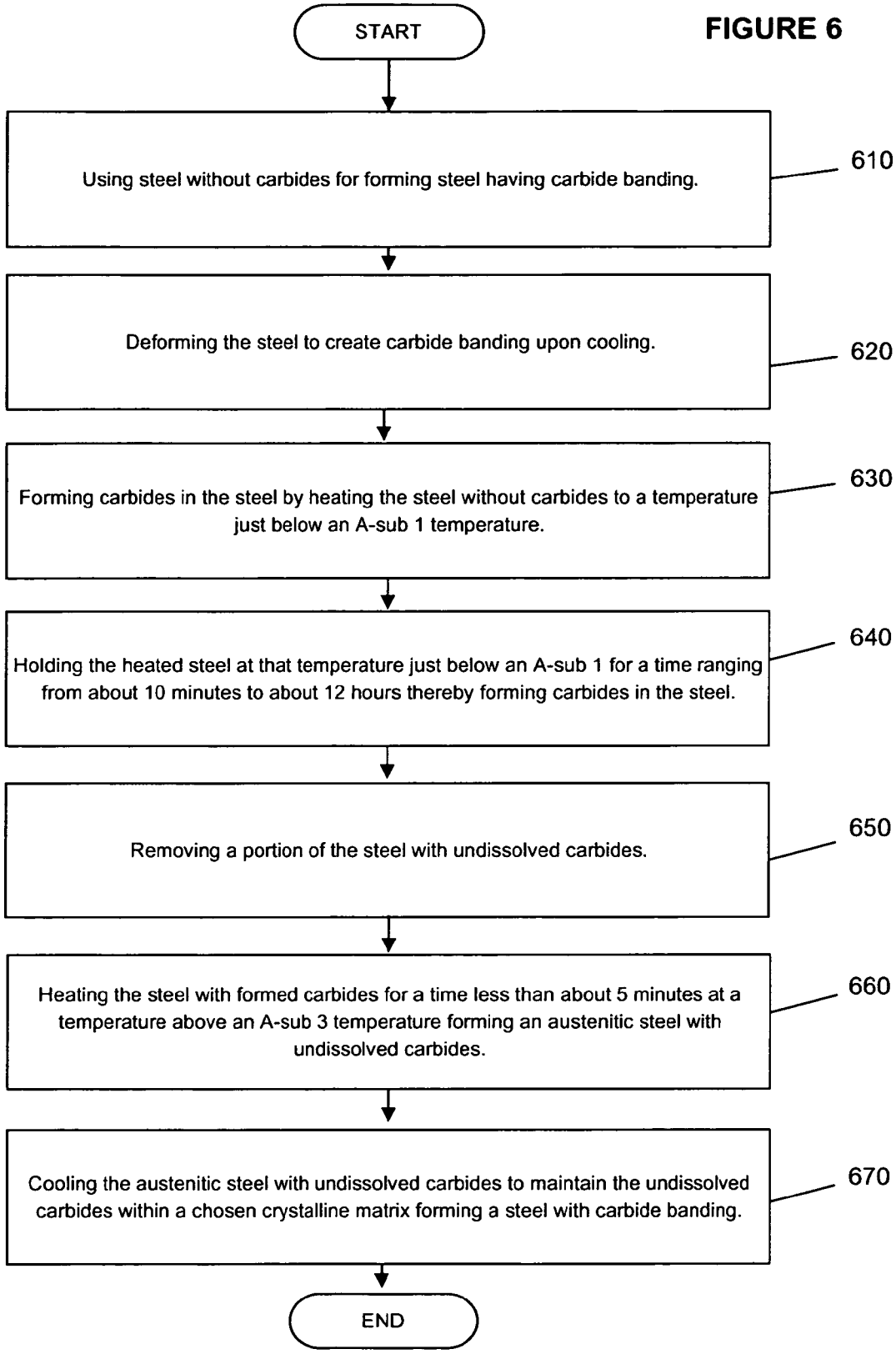
START
FIGURE 6
Using steel without carbides for forming steel having carbide banding.
610
Deforming the steel to create carbide banding upon cooling.
620
Forming carbides in the steel by heating the steel without carbides to a temperature just below an A-sub 1 temperature.
630
Holding the heated steel at that temperature just below an A-sub 1 for a time ranging from about 10 minutes to about 12 hours thereby forming carbides in the steel.
640
Removing a portion of the steel with undissolved carbides.
650
Heating the steel with formed carbides for a time less than about 5 minutes at a temperature above an A-sub 3 temperature forming an austenitic steel with undissolved carbides.
660
Cooling the austenitic steel with undissolved carbides to maintain the undissolved carbides within a chosen crystalline matrix forming a steel with carbide banding.
670
END

METHOD FOR MAKING STEEL WITH CARBIDES ALREADY IN THE STEEL USING MATERIAL REMOVAL AND DEFORMATION

CROSS REFERENCE TO RELATED APPLICATIONS

The present application claims priority to co-pending U.S. Provisional Patent Application Ser. No. 60/582,361 filed on Jun. 23, 2004.

FIELD

The present embodiments relate generally to a method of making steel with carbide banding already in the steel using material removal and deformation.

BACKGROUND

A need exists for a process to treat metals and similar materials of manufacture in order to increase their structural characteristics. For example, in the manufacture of tools and tool components, machinery, engine parts, wear surfaces and like articles from various steels and materials that are used for high wear applications, the common practice is to subject the steel to one or more thermal process treatments, either before or after formation of the steel carbide, so as to modify the properties of at least the exterior of the components. These treatments provide the articles with greater strength, enhanced conductivity, greater toughness, enhanced flexibility, longer wear life, and the like.

A number of thermal type processes are known in the metallurgical arts to enhance the properties of manufacturing materials, such as steels and the like. One widely used class of such metallurgical processes generally known as quenching involves forming an article of the desired metal containing material and then rapidly lowering the temperature of the article followed by a return of the article to ambient temperature. The problem with the current processes controlled or not, is the formation of residual stress in the material. This results in stressing the material and even possibly fracturing the material rendering it useless.

A further enhancement process for manufacturing materials, such as steel, is in the formation of a nitride containing layer on the surface of an article of the metal containing material that hardens the material by forming nitrides such as metal nitrides at or near the surface of an article. The formed nitride surface layer may include extremely hard compounds containing nitrides such as CrN, Fe2N, Fe3N and Fe4N. The formed nitride layer tends to create compressive stresses that improve the properties of the metal containing material, but can also lead to distortions in the article being treated.

The current art describes single wave processes that concentrate on the cryogenic target temperature and possibly one positive range temperature. The focus of the current art on the cryogenic target temperature does not give any regard to the material being treated. The cryogenic phase causes stress in the metal and the subsequent heat process also causes stress in the material. The prior art has done little to deal with these secondary stresses.

A need, therefore, exists, for multi-wave thermal treatments in which the target temperatures are dictated by the material being treated.

A need has long existed for a thermal process to treat a metal or article of manufacture to improve its structural characteristics. The present embodiments meet these needs.

SUMMARY

The invention relates to a method of making steel with carbide banding using steel with undissolved carbides distributed within the steel for forming steel with carbide banding. The steel used is from about 0.3 weight percent to about 2.2 weight percent carbon and at least about 0.003 weight percent of a metal selected from the group consisting of chromium, molybdenum, aluminum, vanadium, tungsten, and a similar carbide forming element.

The method continues by deforming the steel with undissolved carbides, removing a portion of the steel with undissolved carbides, heating the steel with undissolved carbides for a specific time at specific temperature to form austenitic steel with undissolved carbides. The method ends by cooling the austenitic steel with undissolved carbides to maintain the undissolved carbides within a crystalline matrix forming steel with carbide banding.

BRIEF DESCRIPTION OF THE DRAWINGS

The detailed description will be better understood in conjunction with the accompanying drawings as follows:

FIG. 2 is a schematic of an alternative embodiment of the method.

FIG. 3 is a schematic of an alternative embodiment of the method.

FIG. 5 is a schematic of an alternative embodiment of the method.

FIG. 6 is a schematic of an alternative embodiment of the method.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that it can be practiced or carried out in various ways.

The present invention is directed to a method of making steel with carbide banding.

Figure 1:
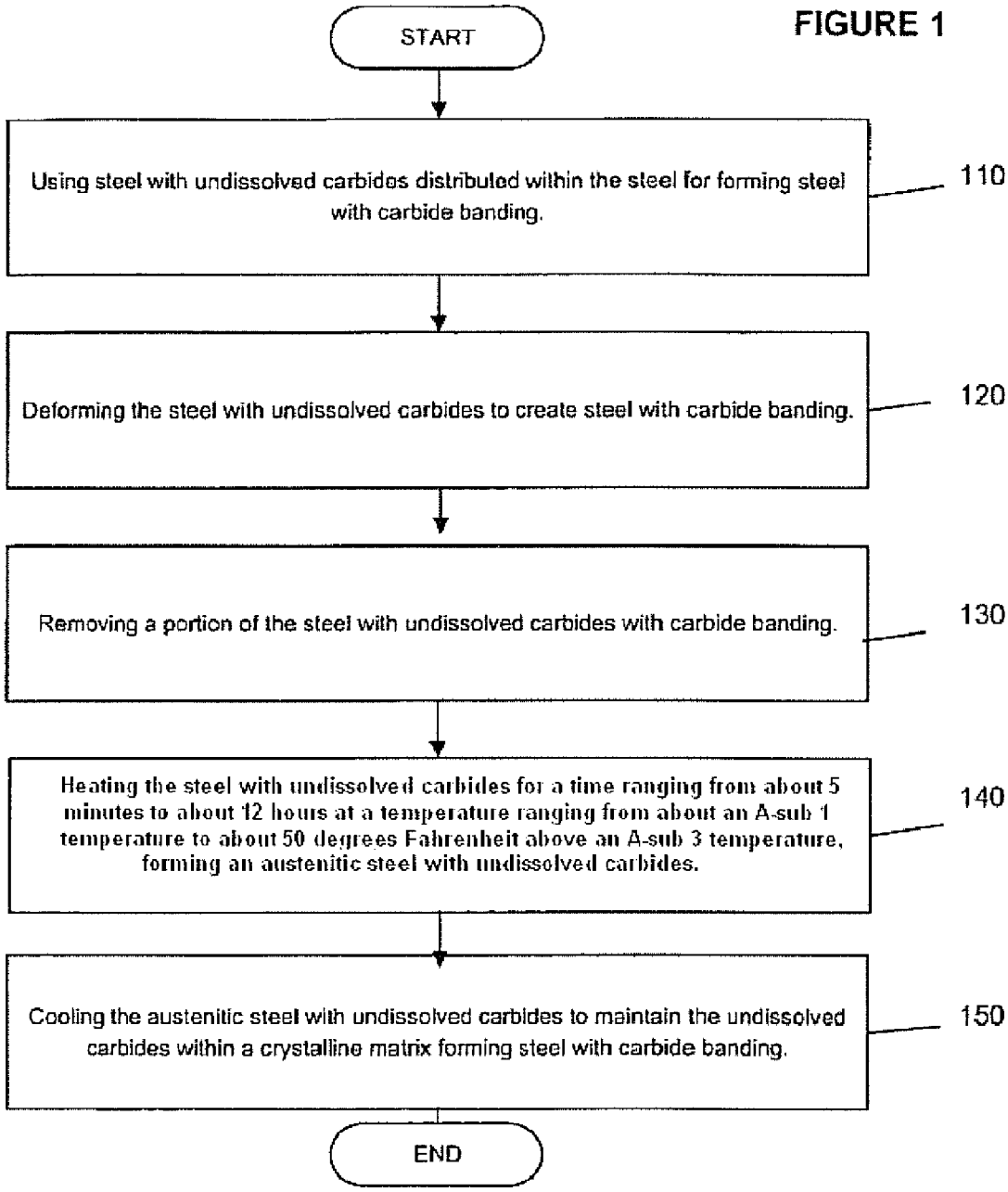
FIG. 1 is a schematic of an embodiment of the method.

Now and with reference to the Figures, FIG. 1 shows a schematic of the overall invention.

The method begins by using steel with undissolved carbides distributed within the steel for forming steel with carbide banding (110) by deforming the steel (120). Deforming the steel is done by the process of hot forging, warm forging, cold forging, bending, hot rolling, cold rolling, extruding, drop forging, twisting, pressing, or combinations of these methods.

The steel is about 0.3 weight percent to about 2.2 weight percent carbon and at least 0.0032 weight percent of a metal. Examples of the metal used in this method are chromium, molybdenum, aluminum, vanadium, tungsten, and similar carbide forming elements.

As seen in FIG. 1, the method continues by removing a portion of the steel with undissolved carbides (130), then, heating the steel with undissolved carbides for a time ranging from about 5 minutes to about 12 hours at a temperature ranging from about an A-sub 1 temperature to about 50 degrees Fahrenheit of an A-sub 3 temperature, forming an austenitic steel with undissolved carbides (140). The A-sub 1 temperature is at least 1330 degrees Fahrenheit. The A-sub 3 temperature ranges from about 1375 degrees Fahrenheit to about 2100 degrees Fahrenheit. The steel with undissolved carbides can be heated for a time ranging from about 20 minutes to about 40 minutes.

Next, the austenitic steel with undissolved carbides is cooled for a time ranging from about 5 minutes to about 6 hours. The cooling is performed so that the austenitic steel with undissolved carbides maintains the undissolved carbides within a crystalline matrix forming steel with carbide banding (150). This cooling can be performed slowly at a temperature from just above 1330 degrees Fahrenheit to create a pearlite and ferrite crystalline matrix.

In FIG. 2. the invention also contemplates that in the alternative the method of making steel having carbide banding by using steel with undissolved carbides distributed within the steel (210) continues by deforming the steel with undissolved carbides to create steel with carbide banding upon cooling (220) and removing a portion of the steel with undissolved carbides (230). Removing a portion of the steel is done by electric discharge machining, grinding, milling, sanding, cutting, machining, filing, laser cutting and combinations thereof. The steel with undissolved carbides is heated for a time less than about 5 minutes at a temperature above an A-sub 3 temperature to form austenitic steel with undissolved carbides (240). The A-sub 3 temperature ranges from about 1375 degrees Fahrenheit to about 2100 degrees Fahrenheit. The austenitic steel with undissolved carbides is then cooled to maintain the undissolved carbides within a chosen crystalline matrix creating carbide banding in the steel (250).

Turning to FIG. 3, an alternative embodiment for making steel with carbide banding is to use steel without dissolved carbides to form carbides in the steel with carbide banding (310) by heating the steel without dissolved carbides at a temperature above an A-sub 1 temperature of at least 1330 degrees Fahrenheit and below 50 degrees Fahrenheit of an A-sub 3 temperature to form austenitic steel with undissolved carbides (320). The A-sub 3 temperature is from about 1375 degrees Fahrenheit to about 2100 degrees Fahrenheit. The heating takes place for a time ranging from about 20 minutes to about 40 minutes.

The method continues by deforming the austenitic steel with undissolved carbides (330), removing a portion of the austenitic steel with undissolved carbides (340), and then cooling the austenitic steel with undissolved carbides to precipitate carbides within a crystalline matrix forming steel with carbide banding (350). The cooling is performed slowly at a temperature from just above 1330 degrees Fahrenheit to create a pearlite and ferrite crystalline matrix. The cooling takes place for a time ranging from about 1 second to about 3 hours, but performed slowly at a temperature from just above 1330 degrees Fahrenheit to create a pearlite and ferrite crystalline matrix, the cooling can occur at a time ranging from about 5 minutes to about 6 hours.

Figure 4:
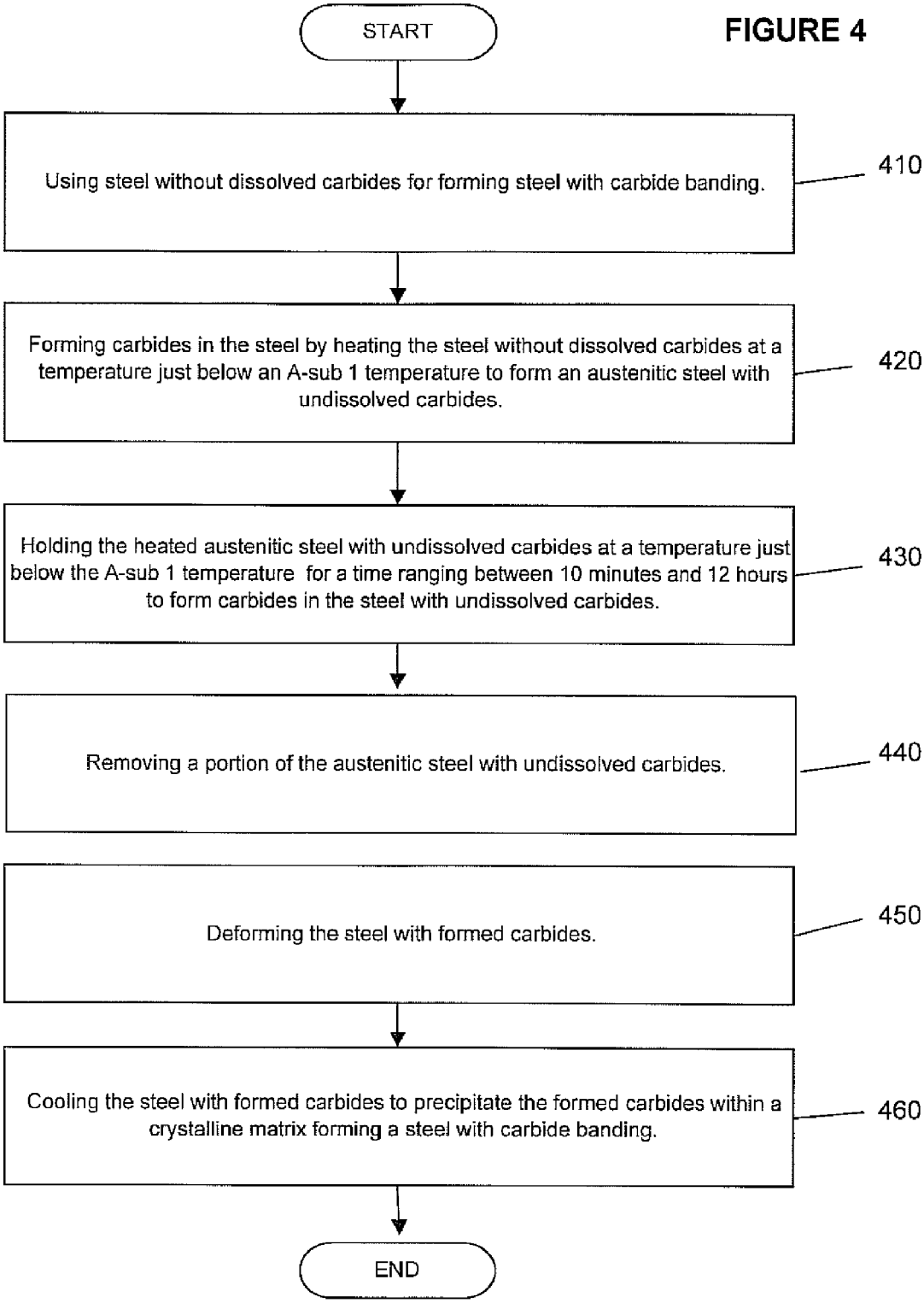
FIG. 4 is a schematic of an alternative embodiment of the method.

The invention as shown in FIG. 4 contemplates that the method of making steel with carbide banding by using steel without dissolved carbides (410) by forming carbides in the steel by heating the steel without dissolved carbides at a temperature just below an A-sub 1 temperature to form austenitic steel with undissolved carbides (420). The heated austenitic steel with undissolved carbides is held at the temperature just below the A-sub 1 for a time ranging from about 10 minutes and 12 hours to form carbides in the steel (430). The method ends by removing a portion of the austenitic steel with undissolved carbides (440), deforming the steel with formed carbides (450), and cooling the steel with formed carbides to precipitate the formed carbides within a crystalline matrix forming steel with carbide banding (460).

In FIG. 5, another alternative method of making steel with carbide banding using steel without dissolved carbides (510) entails forming carbides in the steel by cycling the steel without carbides to a temperature just above an A-sub 1 temperature and just below an A-sub 3 temperature to form austenitic steel with undissolved carbide (520). The method then ends by removing a portion of the steel with undissolved carbides (530), deforming the steel with formed carbides (540), and, then, cooling the steel to precipitate the formed carbides within a crystalline matrix forming a steel with carbide banding (550).

FIG. 6 depicts an embodiment of making steel having carbide banding using steel without carbides (610) and then deforming the steel to create carbide banding upon cooling (620) and forming carbides in the steel, as seen in FIG. 6. The carbides are formed by heating the steel without carbides to a temperature just below an A-sub 1 temperature (630) and holding the heated steel at the temperature just below the A-sub 1 for a time ranging from about 10 minutes to about 12 hours to form carbides in the steel (640).

The method continues by removing a portion of the steel with undissolved carbides (650) and heating the steel with formed carbides for a time less than about 5 minutes at a temperature above an A-sub 3 temperature forming austenitic steel with undissolved carbides (660). The A-sub 3 temperature ranges from about 1375 degrees Fahrenheit to about 2100 degrees Fahrenheit. The method ends cooling the austenitic steel with undissolved carbides to maintain the undissolved carbides within a chosen crystalline matrix forming steel with carbide banding (670).

The step of removing of a portion of the steel with undissolved carbides is completed by electric discharge machining, grinding, milling, sanding, cutting, machining, filing, laser cutting, or combinations of these listed methods. The removed portion of the steel creates a defined pattern, such as a decorative Celtic pattern, a medieval pattern, or an art deco pattern. The defined patterns optimize strength, hardness, and flex properties of the steel. The portion of steel removed ranges from about 5% to about 30% of the overall quantity of the steel.

The step of cooling the austenitic steel with undissolved carbides within a chosen crystalline matrix can be done by air cooling or quenching. Types of quenching can be oil quenching, water quenching, salt quenching, and air quenching. The crystalline matrix can be pearlite, austenite, ferrite, martensite, tempered martensite, bainite, and combinations thereof.

The steel with undissolved carbides in the invention is stainless steel, carbon steel, tool steel, or a steel alloy.

While these embodiments have been described with emphasis on the embodiments, it should be understood that within the scope of the appended claims, the embodiments might be practiced other than as specifically described herein.

What is claimed is:

1. A method of making steel with carbide banding comprising the steps of:

a. obtaining steel with undissolved carbides distributed within the steel for forming steel with carbide banding, wherein the steel comprises:

i. from about 0.3 weight percent to about 2.2 weight percent carbon; and ii. at least about 0.003 weight percent of a metal selected from the group consisting of chromium, molybdenum, aluminum, vanadium, or tungsten;

b. deforming the steel with undissolved carbides;

c. removing a portion of the steel with undissolved carbides;

d. heating the steel with undissolved carbides for a time ranging from about 5 minutes to about 12 hours at a temperature ranging from about an A-sub 1 temperature to about 50 degrees Fahrenheit above an A-sub 3 temperature, forming an austenitic steel with undissolved carbides; and e. cooling the austentitic steel with undissolved carbides to maintain the undissolved carbides within a crystalline matrix forming steel with carbide banding.

2. The method of claim 1, wherein the step of removing a portion of the steel with undissolved carbides is by electric discharge machining, grinding, milling, sanding, cutting, machining, filing, laser cutting, or combinations thereof.

3. The method of claim 1, wherein the step of removing a portion of the steel is removed in a defined pattern.

4. The method of claim 3, wherein the defined pattern optimizes strength, hardness, and flex properties of the steel.

5. The method of claim 3, wherein the defined pattern is a pattern selected from the group consisting of a medieval pattern, decorative Celtic pattern, and an art deco pattern.

6. The method of claim 1, wherein the portion removed ranges from about 5% to about 30% of the overall quantity of the steel.

7. The method of claim 1, wherein the crystalline matrix consists of pearlite, austenite, ferrite, martensite, tempered martensite, bainite, or combinations thereof.

8. The method of claim 1, wherein the steel with undissolved carbides is a member selected from the group consisting of a stainless steel, a carbon steel, a tool steel, and a steel alloy.

9. The method of claim 1, wherein the step of heating is performed at about the A-sub 1 temperature of at least 1330 degrees Fahrenheit.

10. The method of claim 1, wherein the step of heating is performed at about the A-sub 3 temperature ranging from about 1375 degrees Fahrenheit to about 2100 degrees Fahrenheit.

11. The method of claim 1, wherein the step of heating of the steel with undissolved carbides occurs at a time ranging from about 20 minutes to about 40 minutes.

12. The method of claim 1, wherein the step of the cooling the austenitic steel with undissolved carbides occurs at a time ranging from about 1 second to about 3 hours.

13. The method of claim 1, wherein the step of cooling the austenitic steel with undissolved carbides is by air cooling or quenching.

14. The method of claim 13, wherein the step of quenching is by a member selected from the group consisting of: oil quenching, water quenching, salt quenching, air quenching or combinations thereof.

15. The method of claim 1, wherein the step of cooling of the austenitic steel with undissolved carbides is performed slowly at a temperature from just above 1330 degrees Fahrenheit to create a pearlite and ferrite crystalline matrix.

16. The method of claim 1, wherein the step of cooling of the austenitic steel is performed at a time ranging from about 5 minutes to about 6 hours.

17. A method of making steel having carbide banding, comprising the steps of:

a. obtaining steel with undissolved carbides distributed within the steel for forming steel with carbide banding, wherein the steel comprises:

i. from about 0.3 weight percent to about 2.2 weight percent carbon; and ii. at least about 0.003 weight percent of a metal selected from the group consisting of chromium, molybdenum, aluminum, vanadium, or tungsten;

b. deforming the steel with undissolved carbides;

c. removing a portion of the steel with undissolved carbides in a defined pattern selected from the group consisting of: a medieval pattern, decorative Celtic pattern, and an art deco pattern;

d. heating the steel with undissolved carbides for a time less than about 5 minutes at a temperature above an A-sub 3 temperature to form an austenitic steel with undissolved carbides; and e. cooling the austenitic steel with undissolved carbides to maintain the undissolved carbides within a chosen crystalline matrix creating carbide banding in the steel.

18. The method of claim 17, wherein the step of removing of a portion of the steel is by electric discharge machining, grinding, milling, sanding, cutting, machining, filing, laser cutting, or combinations thereof.

19. The method of claim 17, wherein the defined pattern optimizes strength, hardness, and flex properties of the steel.

20. The method of claim 17, wherein the portion removed is from about 5% to about 30% of the overall quantity of the steel.

21. The method of claim 17, wherein the step of heating is performed above the A-sub 3 temperature, whereby the A-sub 3 temperature ranges from about 1375 degrees Fahrenheit to about 2100 degrees Fahrenheit.

22. The method of claim 17, wherein the step of deforming is by hot forging, warm forging, cold forging, hot rolling, cold rolling, extruding, drop forging, bending twisting, pressing or combinations thereof.

23. A method of making steel with carbide banding, comprising the steps of:

a. obtaining steel without dissolved carbides, wherein the steel comprises:

i. from about 0.3 weight percent to about 2.2 weight percent carbon; and ii. at least about 0.003 weight percent of a metal selected from the group consisting of chromium, molybdenum, aluminum, vanadium, or tungsten;

b. forming carbides in the steel by heating the steel without dissolved carbides at a temperature in the range from about an A-sub 1 temperature to about 50 degrees Fahrenheit above an A-sub 3 temperature to form an austenitic steel with undissolved carbides;

c. deforming the austenitic steel with undissolved carbides;

d. removing a portion of the austenitic steel with undissolved carbides;

e. cooling the austenitic steel with undissolved carbides to precipitate carbides within a crystalline matrix forming a steel with carbide banding.

24. The method of claim 23, wherein the crystalline matrix consists of pearlite, austenite, ferrite, martensite, tempered martensite, bainite, or combinations thereof.

25. The method of claim 23, wherein the steel with undissolved carbides is a member selected from the group consisting of a stainless steel, a carbon steel, a tool steel, and an steel alloy.

26. The method of claim 23, wherein the step of heating is performed at the A-sub 1 temperature of at least 1330 degrees Fahrenheit.

27. The method of claim 23, wherein the step of heating is performed at a temperature above the A-sub 3 temperature, wherein the A-sub 3 temperature ranges from about 1375 degrees Fahrenheit to about 2100 degrees Fahrenheit.

28. The method of claim 23, wherein the step of heating of the steel with undissolved carbides occurs from about 20 minutes to about 40 minutes.

29. The method of claim 23, wherein the step of the cooling the austenitic steel with undissolved carbides occurs at a time ranging from about 1 second to about 3 hours.

30. The method of claim 23, wherein the step of cooling the austenitic steel is by air cooling or quenching.

31. The method of claim 30, wherein the step of quenching is by a member selected from the group consisting of: oil quenching, water quenching, salt quenching, air quenching or combinations thereof.

32. The method of claim 23, wherein the step of cooling the austenitic steel is performed slowly at a temperature from just above 1330 degrees Fahrenheit to create a pearlite and ferrite crystalline matrix.

33. The method of claim 23, wherein the step of cooling occurs at a time ranging from about 5 minutes to about 6 hours.

34. The method of claim 23, wherein step of deforming is performed by hot forging, warm forging, cold forging, bending, hot rolling, cold rolling, extruding, drop forging, twisting, pressing, or combinations thereof.

35. The method of claim 23, wherein the step of removing of a portion of the steel with undissolved carbides is by electric discharge machining, grinding, milling, sanding, cutting, machining, filing, laser cutting, or combinations thereof.

36. The method of claim 23, wherein the step of removing of a portion of the steel is removed in a defined pattern.

37. The method of claim 36, wherein the defined pattern optimizes strength, hardness, and flex properties of the steel.

38. The method of claim 36, wherein the defined pattern is a pattern selected from the consisting of a medieval pattern, decorative Celtic pattern, and an art deco pattern.

39. The method of claim 23, wherein the portion removed ranges from about 5% to about 30% of the overall quantity of the steel.

40. A method of making steel with carbide banding, comprising the steps of:

a. obtaining steel without dissolved carbides, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. forming carbides in the steel by heating the steel without dissolved carbides at a temperature just below an A-sub 1 temperature to form an austenitic steel with undissolved carbides;
c. holding the heated austenitic steel with undissolved carbides at the temperature just below the A-sub 1 for a time ranging from about 10 minutes to about 12 hours to form carbides in the steel;
d. removing a portion of the austenitic steel with undissolved carbides;
e. deforming the steel with formed carbides; and
f. cooling the steel with formed carbides to precipitate the formed carbides within a crystalline matrix forming a steel with carbide banding.

41. A method of making steel with carbide banding, comprising the steps of:

a. obtaining steel without dissolved carbides, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. forming carbides in the steel by cyclically heating the steel without carbides to a temperature just above an A-sub 1 temperature and just below an A-sub 3 temperature to form an austenitic steel with undissolved carbide;
c. removing a portion of the steel with undissolved carbides;
d. deforming the steel with formed carbides; and
e. cooling the steel to precipitate the formed carbides within a crystalline matrix forming a steel with carbide banding.

42. A method of making steel having carbide banding, comprising the steps of:

a. obtaining steel without carbides, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. deforming the steel to create carbide banding upon cooling;
c. forming carbides in the steel, comprising the steps of
   i. heating the steel without carbides to a temperature just below an A-sub 1 temperature; and
   ii. holding the heated steel at the temperature just below the A-sub 1 for a time ranging from about 10 minutes to about 12 hours to form carbides in the steel;
d. removing a portion of the steel with undissolved carbides;
e. heating the steel with formed carbides for a time less than about 5 minutes at a temperature above an A-sub 3 temperature forming an austentitic steel with undissolved carbides; and
f. cooling the austentitic steel with undissolved carbides to maintain the undissolved carbides within a chosen crystalline matrix forming a steel with carbide banding.

43. The method of claim 42, wherein the A-sub 3 temperature ranges from about 1375 degrees Fahrenheit to about 2100 degrees Fahrenheit.

44. The method of claim 42, wherein the step of deforming is performed by a member selected from the group consisting of hot forging, warm forging, cold forging, bending hot rolling, cold rolling, extruding, drop forging, twisting, pressing and combinations thereof.

* * * * *